US006138318A

United States Patent [19]

Pyatt et al.

[11] Patent Number: 6,138,318

[45] Date of Patent: Oct. 31, 2000

[54] ZINC DIE CAST CONCRETE IMPLEMENT

[75] Inventors: Georgia Pyatt; Jack D. Murders, both of Fayetteville, Ark.

[73] Assignee: Marshalltown Trowel Company, Marshalltown, Iowa

[21] Appl. No.: 09/187,930

[22] Filed: Nov. 6, 1998

[51] Int. Cl.[7] ..... E01C 19/22; B28B 11/08

[52] U.S. Cl. ..... 15/235.4; 425/458

[58] Field of Search ..... 15/235.4, 235.5, 15/235.8; 425/87, 458

[56] References Cited

U.S. PATENT DOCUMENTS

| | | | |
|---|---|---|---|
| 1,416,521 | 5/1922 | Stout | 15/235.3 |
| 4,397,581 | 8/1983 | Jarvis | 15/235.4 |
| 4,766,635 | 8/1988 | DeVitis . | |
| 5,160,748 | 11/1992 | Gauuan . | |
| 5,632,569 | 5/1997 | Szmansky . | |

*Primary Examiner*—Randall E. Chin
*Attorney, Agent, or Firm*—McAndrews, Held & Malloy, Ltd.

[57] ABSTRACT

A groover comprising a blade and a handle. The blade is a unitary member composed of and die cast from a zinc alloy. Smooth surface geometry provides for easy cleaning of the groover.

16 Claims, 2 Drawing Sheets

ZINC DIE CAST CONCRETE IMPLEMENT

BACKGROUND OF THE INVENTION

The invention relates to a concrete implement, such as a groover, made from a zinc alloy, and more particularly, to a groover which is die cast from a zinc alloy providing smooth surface configuration for ease of cleaning.

Groovers and edgers are well known hand tools or implements used for finishing concrete. A groover is trowel-like in configuration and composed generally of a blade and handle. Extending from the lower side of the blade is a protruding bit which forms a groove in the concrete as the groover is moved back and forth across the top surface of the concrete.

Groovers have been used for decades to create a joint in concrete for providing ornamental appearance and/or a thin area within which freeze/thaw cracks may develop. Heretofore, groovers have for the most part been formed from brass and have been manufactured using a sand cast process. The sand cast process provides a rough surface to the groover requiring its lower working portion to be polished prior to sale. In addition, its top side remains roughened to permit wet concrete to easily adhere to the top side to provide weight to the groover during its use. After such use, the concrete is typically cleaned from the top side.

One of the problems with sand casting is that it provides less dimensional consistency from one groover to the next. Other disadvantages of brass sand casting include the noxious airborne pollutants, including lead, which result during the polishing process and the high liquidous temperature necessary to cast the brass.

SUMMARY OF THE INVENTION

It is therefore an object of the present invention to provide an improved concrete implement, particularly an improved groover and an improved edger.

It is a further object of the present invention to provide a concrete implement with a smooth surface configuration.

It is also an object of the present invention to provide a concrete implement which is easy to clean.

It is a further object of the present invention to provide a concrete implement which may be manufactured with tighter tolerances so as to improve the dimensional consistency between groovers.

It is an additional object of the present invention to manufacture a concrete implement with an expenditure of less energy and little or no noxious airborne pollutants.

These and other objects of the invention are achieved in a concrete implement having a blade of particular configuration. The blade is die cast as a single piece from a zinc alloy. A handle or other mechanism may be attached to the blade.

DETAILED DESCRIPTION OF THE PREFERRED EMBODIMENT

Figure 1:
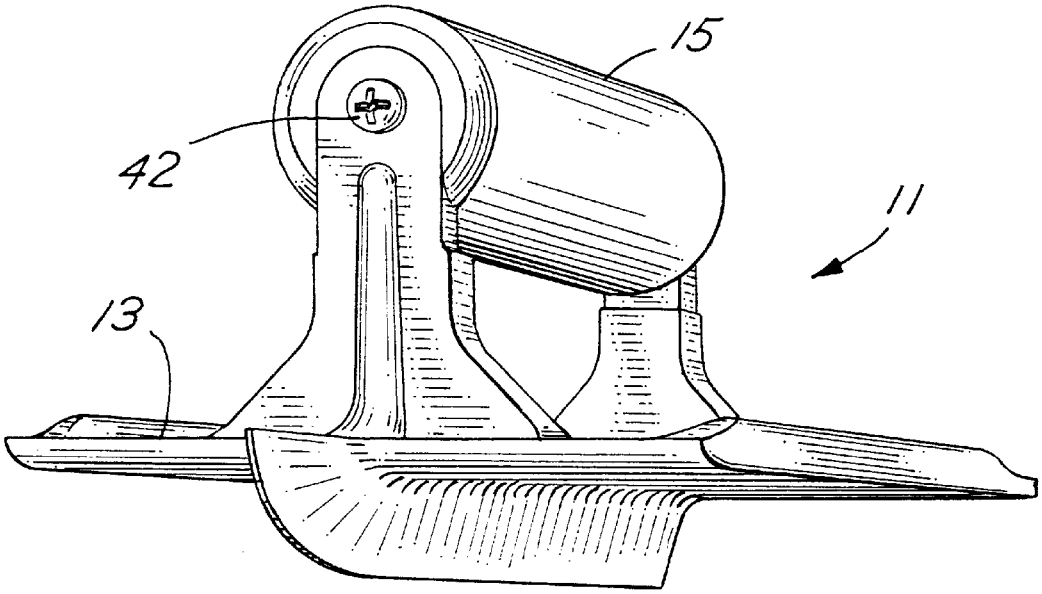
FIG. 1 is a perspective view of a groover embodiment of the present invention.
Figure 2:
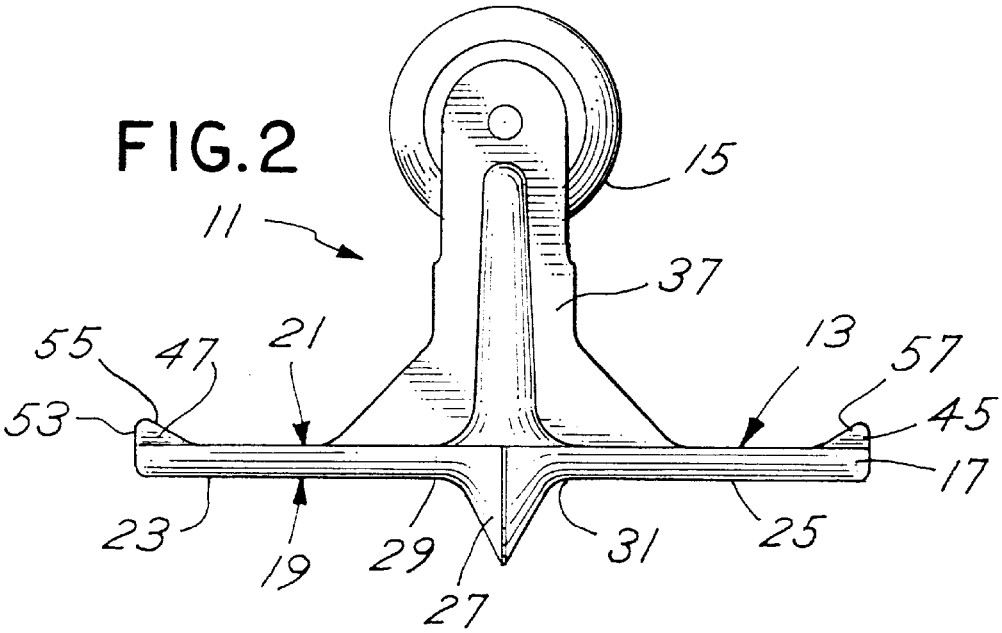
FIG. 2 is an end view of the groover of FIG. 1.

Referring to FIGS. 1 and 2, a groover 11 includes a blade 13 and a wooden handle 15. Blade 13 is die cast as a single metal piece from a zinc alloy. The die casting provides smooth metal surfaces.

Blade 13 includes a central metal body member 17, generally rectangular in shape and having a bottom side 19 and a top side 21. Bottom side 19 includes a pair of smooth planar surfaces 23, 25, of like size, rectangular in shape, and being coplanarly disposed. Planar surfaces 23, 25 serve as concrete support surfaces, making contact with the concrete during use of the groover.

Figure 3:
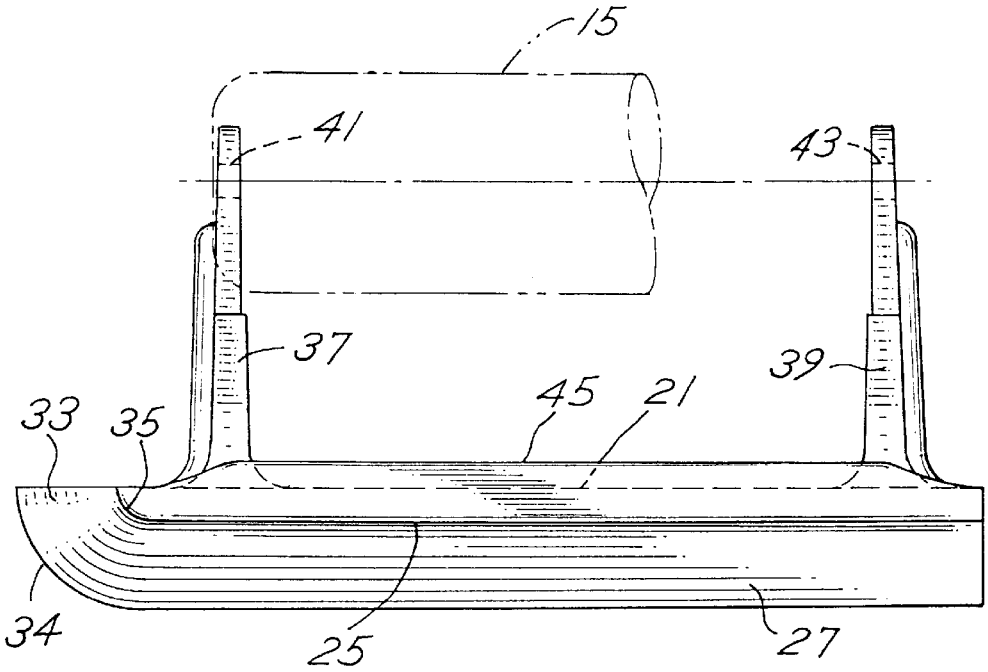
FIG. 3 is a side view of the groover of FIG. 1, with a partial view of its handle in dotted lines.
Figure 4:
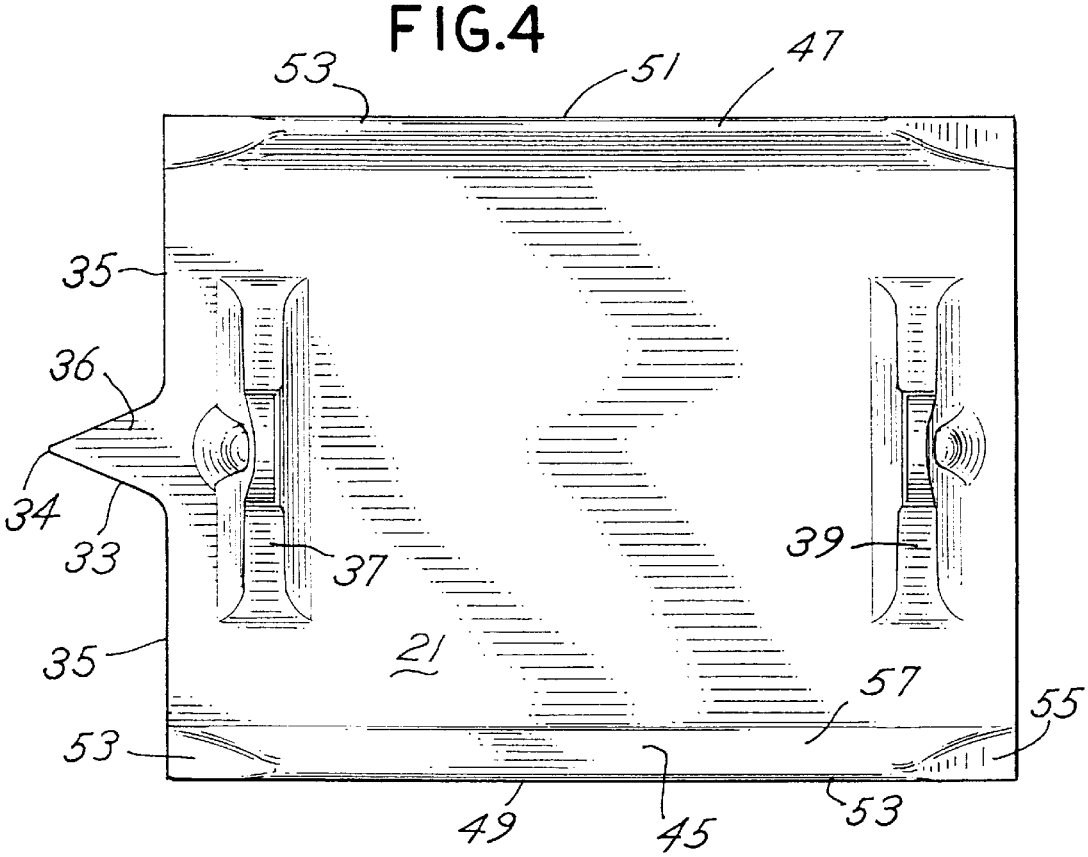
FIG. 4 is a top view of the groover of FIG. 1, without the handle in place.

Disposed between planar surfaces 23, 25 is a grooving bit 27. Bit 27 is disposed adjacent and contiguous to the inner edges 29, 31 of planar surfaces 23, 25, respectively. The bit is thus centrally located on the bottom side of the blade and extends downwardly (or outwardly) from planar surfaces 23, 25. Bit 27 is generally triangular in cross-section, as shown in FIG. 2, and extends longitudinally in length greater than the longitudinal length of surfaces 23, 25, as shown in FIG. 3. The front portion 33 of bit 27 extends forwardly of the planar surfaces 23, 25 and curves upwardly along edge 34 to the top side 21 as shown in FIG. 3. Front portion 33 converges to edge 34 in a triangularly cross-sectional shape, as shown in FIG. 4. Likewise, planar surfaces 23, 25 curve upwardly at their front edge 35 (FIG. 3), to the top side 21.

Groover 11 has no raised lip (at the front edge 35) which extends above the top surface 21. Referring to FIG. 4, the upper surface 36 of bit 28 is coplanar with top side 21 of the blade.

Referring again to FIG. 3, a pair of posts 37, 39 extend upwardly from top side 21 to support wood handle 15. Posts 37, 39 are integrally cast to central body member 17 and are configured with smooth flaring edges where the posts meet with top surface 21. This allows ease of cleaning around the base of the posts.

Wood handle 15 is generally cylindrical in shape and of a size for providing a gripping surface for the user's hand. The handle 15 is secured at each of its ends to the posts 37, 39, and its ends may be provided with a cutout groove to receive the top of the posts. Apertures 41, 43 are formed in the posts for receiving a securement device, such as a wood-type, metal screw 42 (FIG. 1), to secure the handle to the posts. Handle 15 may be formed of material other than wood, for example plastic, as will suggest itself.

In addition, groover 11 may be a walking type groover. Handle 15 would be eliminated in favor of a pole and bracket arrangement for allowing the user to perform the grooving by manipulating the pole.

Referring to FIG. 4, a pair of runners 45, 47 are disposed on the top side of the central body member and are integrally cast thereto. Runners 45, 47 run parallel to the outer edges 49, 51 of the blade and run parallel to the longitudinal axis of the handle 15 and the bit 27. A runner surface 53 faces outwardly from the blade and is disposed substantially orthogonally to planar support surfaces 23, 25, as best seen in FIG. 2. Interior surfaces 55, and 57 are flared to meet smoothly with top surface 21 to allow ease of cleaning around the runners.

Metal blade 13 is die cast from a zinc alloy. For example, a Zamack 3 alloy may be used which is composed of 3.5 to 4.3% aluminum, 0.02 to 0.05% magnesium, 0.25% copper maximum, 0.1% iron maximum, 0.005% lead maximum and 0.004% cadmium maximum, 0.003% tin maximum and the balance zinc. The term zinc alloy herein means an alloy substantially composed of zinc, i.e., where zinc is the primary constituent of the alloy.

While the invention has been particularly shown and described with reference to preferred embodiments thereof, it will be understood by those skilled in the art that various modifications in form and detail may be made therein without departing from the scope and spirit of the invention. Accordingly, modifications such as those suggested above, but not limited thereto are to be considered within the scope of the invention.

For example, a grooving bit element may be attached to a conventional bull float or fresno trowel. Such a grooving bit element is die cast from a zinc alloy and may include integrally cast attachment components to permit securement of the bit element to the float or trowel. Such attachment components would include two brackets, each bracket being located at an end of the bit and configured as a channel for securement to the longitudinal sides of the float or trowel.

In another example, a hand edger or a walking edger may be die cast from a zinc alloy. As understood, the hand edger includes a curved lip located at one outer edge of the blade and extends downward from a flat concrete support surface.

What is claimed is:

1. A groover comprising a blade, said blade formed of a unitary body member with a planar concrete support surface and a grooving bit, said grooving bit disposed adjacent to said support surface and extending outwardly therefrom, said blade being composed of and die cast from a zinc alloy.

2. A groover according to claim 1 and further comprising a handle; and a post extending upwardly from said unitary body member, said handle secured to said post.

3. A groover according to claim 2 wherein said post is integrally cast to said unitary body member.

4. A groover according to claim 3 wherein said unitary body member includes a top surface.

5. A groover according to claim 4 wherein said post is disposed on said top surface.

6. A groover according to claim 5 wherein said post has a base, said base smoothly flaring to meet said top surface.

7. A groover according to claim 2 and further comprising another post extending upwardly from said unitary body member, said another post being secured to said handle.

8. A groover according to claim 1 wherein said blade further includes a top surface and a front surface, said front surface connecting said planar concrete support surface to said top surface.

9. A groover according to claim 8 wherein said unitary body member has two longitudinal sides; and said groover further includes a pair of runners, each disposed at a longitudinal side of said unitary body member, each said runner providing a runner surface facing outwardly from the blade and disposed orthogonally to said planar concrete support surface.

10. A groover according to claim 9 wherein each of said runners includes a leading surface which is smoothly flared to meet with said top surface.

11. A groover according to claim 8 and further including a pair of posts, each of said posts being disposed on said top surface and having a base which is smoothly flared to meet said top surface.

12. A groover according to claim 8 wherein said front surface is disposed below said top surface.

13. A groover according to claim 12 wherein said top surface is planar; and wherein said front surface is disposed below the plane of said top surface.

14. A groover comprising a blade, said blade having attachment components for securing said blade to the underside of a concrete smoothing implement, said blade having a grooving bit, said grooving bit being composed of and die cast from a zinc alloy.

15. A concrete implement comprising a blade, said blade formed of a unitary body member with a planar concrete support surface and a protruding member, said protruding member being disposed adjacent to said support surface and extending outwardly therefrom, said blade being composed of and die cast from a zinc alloy.

16. A concrete implement according to claim 15 wherein said protruding member is a grooving bit of triangular cross-sectional shape.

* * * * *